United States Patent [19]

Kull

[11] Patent Number: 4,710,276

[45] Date of Patent: Dec. 1, 1987

[54] PROCESS FOR THE GALVANOPLASTIC PRODUCTION OF JEWELRY

[75] Inventor: Herbert Kull, Nuremberg, Fed. Rep. of Germany

[73] Assignee: Juwedor GmbH, Fed. Rep. of Germany

[21] Appl. No.: 940,859

[22] Filed: Dec. 12, 1986

[30] Foreign Application Priority Data

Dec. 16, 1985 [DE] Fed. Rep. of Germany ..... 3544429

[51] Int. Cl.[4] ..... C25O 1/02

[52] U.S. Cl. ..... 204/9

[58] Field of Search ..... 204/8, 9, 18.1

[56] References Cited

FOREIGN PATENT DOCUMENTS 1244520 7/1967 Fed. Rep. of Germany ..... 204/8

*Primary Examiner*—T. M. Tufariello

[57] ABSTRACT

Substantially hollow jewelry items made from metals, particularly precious metals, can be produced galvanoplastically, in that the metal is electrolytically deposited on an electrically conductive mould core having the spatial contour of the jewelry item, after reaching the desired coating thickness the core is chemically or thermally dissolved and the core material removed through an opening in the metal coating. In order to be able to provide such jewelry items with stones, particularly gems or semiprecious stones, the mould core is provided in the vicinity of the gem mount with a mould surface forming the gem support and nose, web or ring-like projections surrounding the same and that after removing the core material the gem is placed on the gem support and the mount parts formed by the projections are pressed onto the gem.

14 Claims, 4 Drawing Figures

PROCESS FOR THE GALVANOPLASTIC PRODUCTION OF JEWELRY

BACKGROUND OF THE INVENTION

The invention relates to a process for the galvanoplastic production of substantially hollow jewelry made from metals, particularly precious metals with a least one mount for a stone, particularly a gem or semiprecious stone, in that the precious metal is electrolytically deposited on an electrically conductive mould core having the spatial contour of the piece of jewelry, after reaching the desired coating thickness the core is chemically or thermally dissolved and the core material removed through an opening in the precious metal coating.

Although the use of galvanoplastics or electroforming has long been known in the production of jewelry, particularly made from precious metals, the use of the process has hitherto been limited to exceptional cases, particularly the production of replicas of valuable originals or voluminous pieces of jewelry, in which a solid construction would lead to an excessive weight. However, it was disadvantageous in this connection that an electrolytic deposition from gold baths was only possible in the case of a relatively high fineness or carat level. However, of late baths and technologies have been developed enabling the deposition of finenesses starting from 8 carat. This has lead to a revival of this technology in the jewelry industry, so that nowadays jewelry of random shape and low carat values can be galvanoplastically produced. The coating thickness is a few hundred microns, so that attractive and at the same time lightweight pieces of jewelry can be produced which, despite their hollow construction, have an adequate dimensional stability.

In connection with the technology it is pointed out that the mould core is produced in conventional manner in a negative die of the piece of jewelry by slush moulding and it is possible to use all materials which can be thermally or chemically liquefied or volatilized, without attacking the metal. In the case of materials which are not in themselves electrically conductive, such as e.g. waxes, the mould core is electrically conductively coated with a metal and optionally the wax immediately removed, so that a hollow mould core is obtained. The dissolved core metal is removed through an opening in the precious metal coating formed during the deposition process or made subsequently.

In the case of jewelry items which are to be subsequently set with stones, particularly gems and which for this purpose must have corresponding amounts, it was not hitherto possible to use the galvanoplastic process or the galvanoplastically produced blank was separated in the vicinity of the mount and a conventionally cast solid part with a mount was soldered in. This process is naturally complicated and time-consuming and makes the piece of jewelry much more expensive.

In the case of conventional member mounts, the members are made from web or bar-like, solid sheet metal strips, which are conventionally soldered to the gem support and engage over the edges of the gem after pressing on. In the special case of the chaton mount, high, narrow webs are involved and engage round the edges of the gem in finger-like manner. Much the same applies with granular mounts, in which the gem is secured by individual small pin or column-like "granules", which project over the gem support and consequently also form a grazile mount with a greater incidence of light. In conventional processing the granules are obtained in that a type of chip is cut out from the solid mount material, bent up and subsequently shaped to form a head by mechanical working, the circumference of the gem being secured by several such granules. In certain cases the wall of the mount is subsequently worked out into the vicinity of the gem support, in order to obtain an even greater incidence of light. The gem support generally comprises solely a bearing or support ring, so that the back of the gem is also free for the incidence of light. Granular mounts include carreau, filamentary and pave mounts, which generally comprise sequenced or grid-like individual mounts. The frame or border mounts differ therefrom and generally engage in circular manner around the entire circumference of the gem and in general give a more solid impression.

SUMMARY OF THE INVENTION

The problem of the present invention is to so further develop the aforementioned galvanoplastic process that, without additional operations, it is also possible to produce jewelry items with mounts for stones, particularly gems.

On the basis of the known process, this problem is solved in that the mould core is provided in the vicinity of the mount with a mould surface forming the gem support and nose, ring or web-like projections surrounding the same and after removing the core material the gem is placed on the gem support and the mount parts formed by the projections are pressed onto the gem.

In the case of the process according to the invention on the mould core is firstly provided a mould surface forming the gem support and also web-like, ring-like or nose-like projections are formed on which the precious metal is deposited in equi-contour manner, so that after melting or dissolving the core material a jewelry blank is obtained having on the one hand a gem support and on the other in the vicinity of the web, nose or ring-like projections of the mould core individual mount parts (members or granules) or a closed mount part (border or frame), said mount parts being hollow. The gem is then mounted on the gem support of the optionally subsequently treated jewelry blank. The mount parts are subsequently mechanically shaped and pressed onto the edges of the gem, so that the gem is secured as in a conventional mount.

According to an alternative solution of the inventive problem, in the vicinity of the mount, the mould core is provided with a mould surface forming a gem support and with nose, ring or web-like projections surrounding the same and after removing the core material the gem is placed on the mount parts formed by the projections and the gem support is pressed onto the gem.

This process variant offers the possibility of carrying out the mounting or setting work from the back of the item of jewelry, so that the mount parts on the visible side do not have to be worked or shaped. This facilitates setting and in particular there are no externally visible traces of the work. This process can in particular be used if the metal body is constructed similar to a hollow relief and not as a closed hollow body.

According to an embodiment of the invention, the metal coating is broken away in the central region of the gem support, whilst leaving a support ring. This can e.g. be facilitated in that the mould surface on the mould core used for shaping the gem support has a linear projection or depression or a linear, electrically non-conductive covering in the region which is subsequently to be broken away. This leads to a desired breaking line, which facilitates the breaking away of the metal coating in this region. Instead of this, the mould core can be made electrically non-conductive throughout this region. This can e.g. take place by an insulating covering or the like. This embodiment leads to a mount, in which the gem is also exposed at the rear, so that it appears with greater brilliance.

According to a further development of the invention, the metal coating is broken away on the back of the jewelry item facing the mount or the mould core is electrolytically shielded on the back facing the subsequent mount. As a result of this measure two effects are obtained. Firstly the gem placed in the mount is free at the rear for the incidence of light, so that it appears with even better brilliance and secondly the mount is accessible from the back of the jewelry item, so that it is possible to separate or cut out the precious metal coating in the vicinity of the gem support.

This also facilitates the insertion and setting of the gem from the rear.

Finally, according to the invention, the hollow mount parts are filled with metal, particularly precious metal after dissolving out the mould core. The measure stabilizes the hollow mount parts so that, to the extent necessary, they are not damaged during working and the gem has an even better hold after setting.

BRIEF DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENTS

Figure 1:
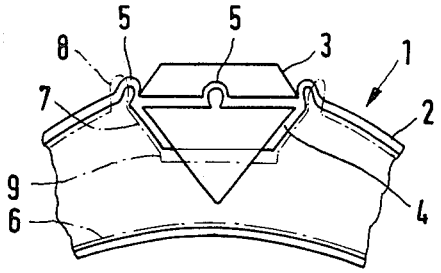
FIG. 1, a section through a jewelry item with member mount.

FIG. 1 shows in diagrammatic and broken away form a jewelry item 1 obtained with a thin wall 2 by electrolytic deposition on a mould core and in which is subsequently inserted a gem 3. Jewelry item 1 has an annular gem support 4, on whose upper edge are arranged several and in the present embodiment four granules 5 in a symmetrical manner (cf FIG. 2). Gem 3 is secured by pressing granules 5 onto the upper gem faces.

The complete jewelry item 1, including the gem support 4 and granules 5 is produced by electrolytic deposition on a mould core 6, shown by dot-dash lines in FIG. 1 made from electrically conductive or correspondingly coated material. In the vicinity of the annular gem support 4, mould core 6 has a equi-contour depression 7 on whose upper edge are provided substantially vertical, nose-like projections 8 corresponding to the number of desired granules 5. In the vicinity of the lower edge of the gem support 4 a cavity 9 is connected to the depression 7 in the mould core, so that an edge is formed between depression 7 and cavity 9. On depositing the precious metal coating on the mould core inhomogeneities similar to a desired breaking line are formed in the vicinity of said edge, so that the precious metal deposited in cavity 9 can easily be broken away and consequently an annular or circular gem support 4 is formed, so that the gem 5 is not shaded at the rear. In place of the cavity 9 in mould core 6, the bottom of the depression 7 can also be made electrolytically non-conductive, e.g. by providing with an insulating coating.

Figure 2:
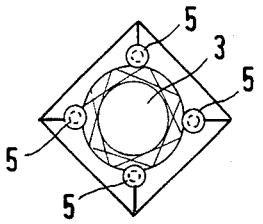
FIG. 2, a plan view of the jewelry item according to FIG. 1 in the manner of a carreau mount.

The optical effect of gem 3 can be further increased in that type of carreau mount according to FIG. 2 is chosen and this accentuates the gem as compared with the surrounding jewelry item.

Figure 3:
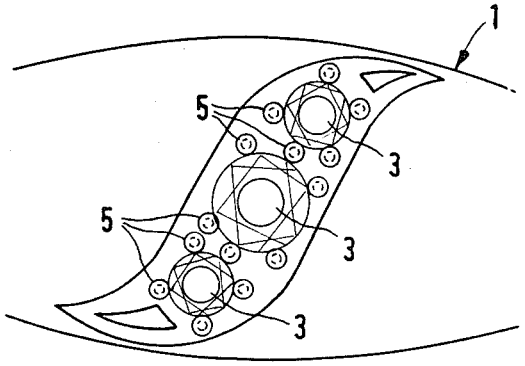
FIG. 3, a view of a jewelry item with a pave mount.
Figure 4:
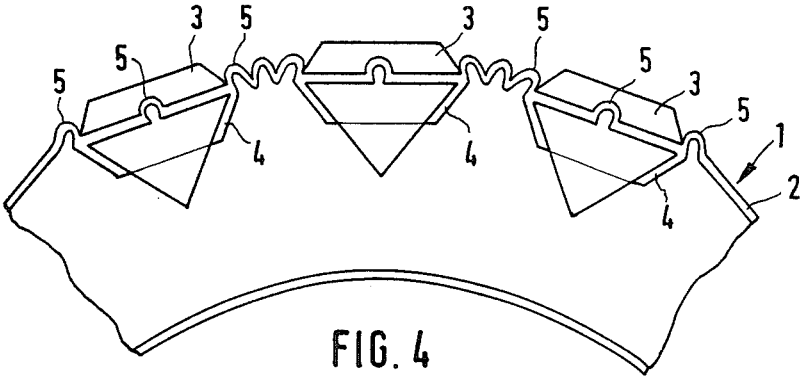
FIG. 4, a section IV—IV according to FIG. 3.

As shown by FIGS. 3 and 4 it is possible in this way to arrange several gems, similar to a pave mount on a piece of jewelry. Here again they are granular mounts. This makes it possible to produce all other mount types, in that then the projection 8 is not nose-like and instead is in the form of attachments with a corresponding contour and arrangement.

Mould core 6 can also be constructed in such a way that on the back of the jewelry item facing the mount either no precious metal is deposited, or the precious metal coating can be subsequently removed, so that the mount is accessible from the rear. This also makes it possible to obtain the mount parts on the visible side, e.g. the granules 5 or an all-round frame in their final form during electrolytic deposition and then to use the same as the gem support for the gem 3 to be inserted from the rear. During electrolytic deposition, the support ring 7 is then constructed in such a way that the gem 3 can be inserted and subsequently the support ring or individual precious metal coating strips are pressed against the back of gem 3.

The mount parts and in the represented embodiments the granules 5, after electroforming, appear as hollow attachments, projections, etc. They can be made at least partly solid by filling from the open rear of the jewelry item. For example, for filling purposes, it is possible to use a precious metal alloy with a somewhat lower melting point. As a result of this construction it is better possible to absorb the shaping forces when setting the gem and the latter is given a better hold.

What is claimed is:

1. A process for the galvanoplastic production of substantially hollow jewelry made from metal with at least one mount for a stone, wherein the metal is electrolytically deposited on an electrically conductive mould core to form a metal coating having the spatial contour of a piece of jewelry having a mount, wherein after reaching the desired coating thickness the core material is dissolved and removed through an opening in the metal coating, wherein the mould core is provided in the vicinity of the mount with a mould surface forming in the metal coating a gem support and projections surrounding the same, and wherein after removing the core material a gem is placed on the gem support and the projections are pressed onto the gem to hold it in place on the support.

2. A process for the galvanoplastic production of substantially hollow jewelry made from metal with at least one mount for a stone, wherein the metal is electrolytically deposited on an electrically conductive mould core to form a metal coating having the spatial contour of a piece of jewelry having a mount, wherein after reaching the desired coating thickness the core material is dissolved and removed through an opening in the metal coating, wherein in the vicinity of the mount the mould core is provided with a mould surface forming in the metal coating a gem support and projections surrounding the same, and wherein after removing the core material a gem is placed on the projections and the gem support is pressed onto the gem to hold it in place on the projections.

3. A process according to claim 1 wherein the metal coating is partially absent in the vicinity of the gem support so as to leave behind a support ring for the gem.

4. A process according to claim 3 wherein the metal coating is broken away in the vicinity of the gem support so as to leave behind said support ring, and wherein the mould surface on the mould core used for shaping the gem support is provided with a linear means for forming in the metal coating a desired breaking line bounding said support ring.

5. A process according to claim 3 wherein the mould core is electrolytically shielded in the central region of its mould surface forming the gem support in such a way as to form said support ring.

6. A process according to claim 1 wherein the metal coating is broken away on the back of the jewelry item facing the mount.

7. A process according to claim 1 wherein on the back facing the subsequent mount, the mould core is electrolytically shielded.

8. A process according to claim 1 wherein the metal coating in the vicinity of said mount is hollow, and wherein said metal coating in the vicinity of said mount is filled with metal after dissolving out the mould core material.

9. A process according to claim 2, wherein the metal coating is partially absent in the vicinity of the gem support so as to leave behind a support ring for the gem.

10. A process according to claim 9, wherein the metal coating is broken away in the vicinity of the gem support so as to leave behind said support ring, and wherein the mould surface on the mould core used for shaping the gem support is provided with a linear means for forming in the metal coating a desired breaking line bounding said support ring.

11. A process according to claim 9, wherein the mould core is electrolytically shielded in the central region of its mould surface forming the gem support in such a way as to form said support ring.

12. A process according to claim 2, wherein the metal coating is broken away on the back of the jewelry item facing the mount.

13. A process according to claim 1, wherein on the back facing the subsequent mount, the mould core is electrolytically shielded.

14. A process according to claim 2, wherein the hollow metal coating in the vicinity of said mount is hollow, and wherein said metal coating in the vicinity of said mount is filled with metal after dissolving out the mould core material.

* * * * *